US007646346B2

(12) United States Patent
Ying

(10) Patent No.: US 7,646,346 B2
(45) Date of Patent: Jan. 12, 2010

(54) ANTENNA FOR A PEN-SHAPED MOBILE PHONE

(75) Inventor: Zhinong Ying, Lund (SE)

(73) Assignee: Sony Ericsson Mobile Communications AB, Lúnd (SE)

( * ) Notice: Subject to any disclaimer, the term of this patent is extended or adjusted under 35 U.S.C. 154(b) by 406 days.

(21) Appl. No.: 11/558,754

(22) Filed: Nov. 10, 2006

(65) Prior Publication Data

US 2008/0111747 A1 May 15, 2008

(51) Int. Cl.
*H01Q 1/24* (2006.01)

(52) U.S. Cl. ..... 343/702

(58) Field of Classification Search ..... 343/702, 343/700 MS, 895

See application file for complete search history.

(56) References Cited

U.S. PATENT DOCUMENTS

| | | | | |
|---|---|---|---|---|
| 3,071,771 | A | 1/1963 | Scheldorf | |
| 5,418,543 | A | 5/1995 | Bolton | |
| 5,448,253 | A | 9/1995 | Ponce de Leon et al. | |
| 5,673,054 | A * | 9/1997 | Hama | 343/744 |
| 5,724,045 | A | 3/1998 | Kawakami | |
| 5,940,041 | A * | 8/1999 | Koyama et al. | 343/702 |
| 5,969,680 | A * | 10/1999 | Tsuru et al. | 343/700 MS |
| 6,452,554 | B1 * | 9/2002 | Aoyama et al. | 343/702 |
| 6,509,893 | B1 | 1/2003 | Akhlagi et al. | |
| 6,947,762 | B1 * | 9/2005 | Kuramoto | 455/550.1 |
| 6,963,310 | B2 * | 11/2005 | Horita et al. | 343/702 |
| 7,042,402 | B2 * | 5/2006 | Modro | 343/700 MS |
| 7,423,598 | B2 | 9/2008 | Bit-Babik et al. | |
| 2001/0002823 | A1 | 6/2001 | Ying | |
| 2002/0068603 | A1 | 6/2002 | Ito et al. | |
| 2004/0012530 | A1 | 1/2004 | Chen | |
| 2004/0070541 | A1 | 4/2004 | Andersson et al. | |
| 2004/0090372 | A1 | 5/2004 | Nallo et al. | |
| 2005/0243007 | A1 | 11/2005 | Ke et al. | |
| 2005/0280586 | A1 * | 12/2005 | Bit-Babik et al. | 343/702 |
| 2006/0232482 | A1 | 10/2006 | Chen | |

FOREIGN PATENT DOCUMENTS

| | | |
|---|---|---|
| EP | 1 403 964 A1 | 3/2004 |
| EP | 1 575 123 A1 | 9/2005 |
| GB | 2 293 494 A | 3/1996 |
| JP | 10-32409 | 2/1998 |

OTHER PUBLICATIONS

U.S. Appl. No. 11/627,471, filed Jan. 26, 2007; Z. Ying: "Antenna for a Pen-Shaped Mobile Phone", 14 pages, 6 pages of drawings.

* cited by examiner

*Primary Examiner*—Huedung Mancuso
(74) *Attorney, Agent, or Firm*—Harrity & Harrity, LLP

(57) ABSTRACT

The present invention relates to an antenna arrangement for a thin elongated portable communication device as well as to a thin elongated portable communication device comprising such an antenna arrangement. The antenna arrangement includes a first radiating antenna element dimensioned for operation at a first frequency and provided in the form of a first strip encircling most of a circuit board that comprises a ground plane. The antenna arrangement that is small sized, can be provided inside the thin elongated portable communication device and still has good antenna properties.

22 Claims, 2 Drawing Sheets

ANTENNA FOR A PEN-SHAPED MOBILE PHONE

TECHNICAL FIELD

The present invention relates to the field of antennas and, more particularly, to an antenna arrangement for an elongated portable communication device, as well as to an elongated portable communication device having such an antenna arrangement.

DESCRIPTION OF RELATED ART

Portable communication devices like mobile phones are increasingly becoming smaller and smaller. In relation to such small devices, unconventional shapes, dimensions, and designs are furthermore being considered. Thus, portable communication devices may now have virtually any shape and/or dimensions.

One type of unconventional shape is a pen shape. Pen-shaped devices are present in various related fields. A wireless communication device in the form of a pen is, for instance, the so-called "C-pen." One C-pen type of pen is described in U.S. Pat. No. 6,509,893, in which characters can be optically read from a page by the pen and transferred wirelessly to, for instance, a computer.

When using such a relatively small, elongated portable communication device, it is therefore of interest also to provide a complementary antenna arrangement that is likewise small, can be provided inside such a small device, and still retain good antenna properties for the frequencies that are of interest.

SUMMARY

The present invention is generally directed to providing an antenna arrangement that is relatively small, can be provided inside am elongated portable communication device, and still exhibit superior antenna properties for the frequencies that are of interest.

One object of the present invention is thus to a thin elongated portable communication device having an antenna arrangement that is small, can be provided inside the device and still has good antenna properties for the frequencies that are of interest.

According to a first aspect of the present invention, this object is achieved by a thin elongated portable communication device comprising: a thin elongated circuit board including a ground plane, and an antenna arrangement including, a first radiating antenna element dimensioned for operation at a first frequency and provided in the form of a first strip encircling most of said circuit board.

A second aspect of the present invention is directed towards a portable communication device including the features of the first aspect, wherein the first radiating antenna element covers an angle in the range of 270-350 degrees of a full circle around the circuit board, with advantage in the range of 390-340, and preferably an angle of about 315 degrees.

A third aspect of the present invention is directed towards a portable communication device including the features of the first aspect, wherein the first frequency is a short range wireless communication frequency.

A fourth aspect of the present invention is directed towards a portable communication device including the features of the first aspect, wherein the antenna arrangement comprises a second radiating antenna element dimensioned for operation at a second frequency and provided in the form of a second strip.

A fifth aspect of the present invention is directed towards a portable communication device including the features of the fourth aspect, wherein the second radiating antenna element is connected to the first radiating antenna element.

A sixth aspect of the present invention is directed towards a portable communication device including the features of the fourth aspect, wherein the second strip encircles about half of the circuit board.

A seventh aspect of the present invention is directed towards a portable communication device including the features of the fourth aspect, wherein the second frequency band is a short range wireless communication frequency.

An eighth aspect of the present invention is directed towards a portable communication device including the features of the first aspect, wherein the first radiating antenna element is provided at an upper end of the circuit board and the antenna arrangement further comprises a third radiating antenna element provided at a lower end of the circuit board and dimensioned for operation in at least one frequency band.

A ninth aspect of the present invention is directed towards a portable communication device including the features of the eighth aspect, wherein the third radiating antenna element is a monopole antenna.

A tenth aspect of the present invention is directed towards a portable communication device including the features of the eighth aspect, wherein the third radiating antenna element is a meandering strip antenna element.

An eleventh aspect of the present invention is directed towards a portable communication device including the features of the eighth aspect, wherein the frequency band is a mobile communication frequency band.

A twelfth aspect of the present invention is directed towards a portable communication device including the features of the first aspect, wherein it is a mobile phone.

Another object of the present invention is to provide an antenna arrangement for a thin elongated portable communication device that is small, can be provided inside the device and still has good antenna properties for the frequencies that are of interest.

According to a thirteenth aspect of the present invention, this object is achieved by an antenna arrangement for a thin elongated portable communication device and including:

a first radiating antenna element dimensioned for operation at a first frequency and provided in the form of a first strip encircling most of a circuit board that comprises a ground plane.

A fourteenth aspect of the present invention is directed towards an antenna arrangement including the features of the thirteenth aspect, wherein the first radiating antenna element covers an angle in the range of 270-350 degrees of a full circle around the circuit board, with advantage in the range of 390-340, and preferably an angle of about 315 degrees.

A fifteenth aspect of the present invention is directed towards an antenna arrangement including the features of the thirteenth aspect, wherein the first frequency is a short range wireless communication frequency.

A sixteenth aspect of the present invention is directed towards an antenna arrangement including the features of the thirteenth aspect, further comprising a second radiating antenna element dimensioned for operation at a second frequency and provided in the form of a second strip.

A seventeenth aspect of the present invention is directed towards an antenna arrangement including the features of the sixteenth aspect, wherein the second radiating antenna element is connected to the first radiating antenna element.

An eighteenth aspect of the present invention is directed towards an antenna arrangement including the features of the sixteenth aspect, wherein the second strip encircles about half of the circuit board.

A nineteenth aspect of the present invention is directed towards an antenna arrangement including the features of the sixteenth aspect, wherein the second frequency is a short range wireless communication frequency.

A twentieth aspect of the present invention is directed towards an antenna arrangement including the features of the thirteenth aspect, wherein the first radiating antenna element is to be provided at an upper end of the circuit board and further comprising a third radiating antenna element to be provided at a lower end of the circuit board and dimensioned for operation in at least one frequency band.

A twenty-first aspect of the present invention is directed towards an antenna arrangement including the features of the twentieth aspect, wherein the third radiating antenna element is a monopole antenna.

A twenty-second aspect of the present invention is directed towards an antenna arrangement including the features of the twentieth aspect, wherein the third radiating antenna element is a meandering strip antenna element.

A twenty-third aspect of the present invention is directed towards an antenna arrangement including the features of the twentieth aspect, wherein the frequency band is a mobile communication frequency band.

The invention has a number of advantages. It provides a small sized antenna arrangement that can be provided inside a thin elongated portable communication device and still have good antenna properties for the frequencies that are of interest. It is further simple and can be produced at a low cost.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF THE INVENTION

Figure 1:
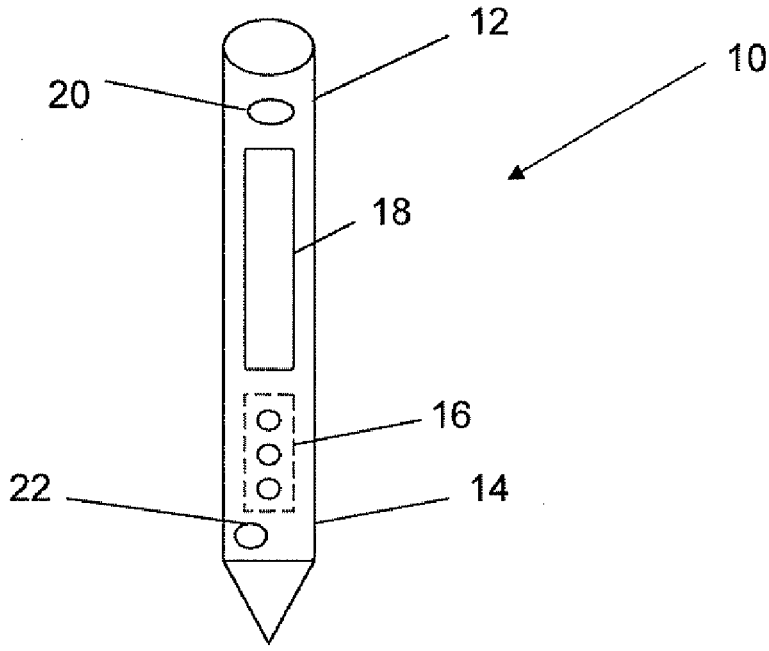
FIG. 1 shows a front view of a portable communication device in the form of a pen-shaped mobile phone.

FIG. 1 shows a front view of an exemplary portable communication device, such as phone 10, in the form of an elongated mobile phone. The shape shown here is that of a pen. Other shapes are possible. For instance, regular or irregular shapes, such as substantially cylindrical shapes, elongated cone shapes, etc.

Phone 10 may include a first (e.g., "lower") end 14, at which a microphone 22 and a set of tactile user input units 16, for example, in the form of a number (here three) of buttons, may be disposed. Input units 16 are here indicated by a dashed box. Pen 10 may include an opposing second (e.g., "upper") end 12, at which a speaker 20 may be disposed. In an approximate middle of pen 10, i.e., between the upper and lower ends 12, 14, a display 18 may be disposed. Other functional components, such as other types of input mechanisms are possible.

For example, various other functional units of phone 10 may be provided in an interior of phone 10, i.e., within a housing or casing of a body of phone 10. Phone 10 may furthermore include at least one antenna arrangement, which may be provided entirely or partially within the interior of phone 10. Phone 10 may here include other functionality, for instance, optical reading of text. Phone 10 may be configured to retain and/or dispense ink in a manner for use as a conventional pen. Phone 10 may furthermore include any of the functions typically provided in current mobile phones, for instance, as a music player and/or a camera, as well as any other functions.

Figure 2:
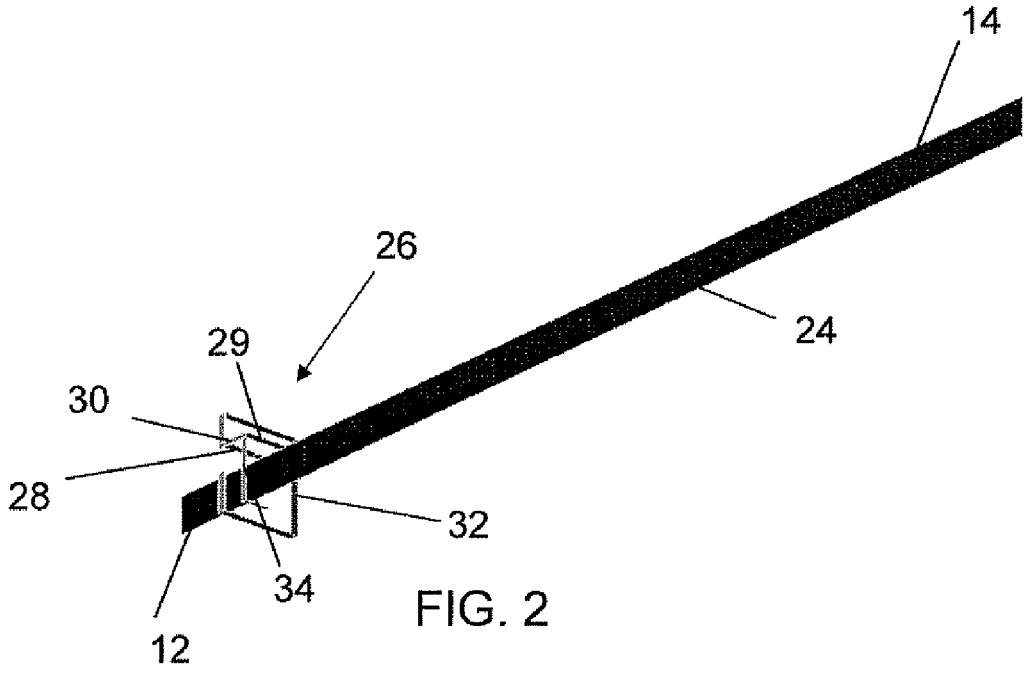
FIG. 2 shows a perspective view of the antenna arrangement according to the present invention provided around a circuit board of the pen-shaped mobile phone at an upper part of the board.

FIG. 2 shows a perspective view of an exemplary antenna arrangement 26, according to one implementation consistent with the principles of the invention, as being provided in relation to a circuit board 24 that may include a ground plane. Circuit board 24 may extend throughout the casing or body of phone 10 and may have opposing "upper" and "lower" ends, which are likewise denoted with reference numerals 12 and 14 in FIG. 2 and substantially corresponding to upper and lower ends 12, 14 as in FIG. 1. Circuit board 24 may furthermore include a radio circuit (not shown) arranged thereon via which to feed antenna arrangement 26 with a number of signals, for example, two signals provided at two separate and distinct frequencies.

Antenna arrangement 26 may be provided at upper end 12 of the circuit board 24 and may include a feeding leg 28 connected to the radio circuit. Feeding leg 28 may extend straight out from an upper surface of circuit board 24 to a feeding plane provided above and in parallel with the upper surface of circuit board 24. Feeding leg 28 may connect to a feeding portion 30 provided in the feeding plane. Feeding portion 30 may be provided as a metallic strip and connect to a grounding leg 29 that connects to the ground of circuit board 24. Feeding section 30 may connect to both a first radiating antenna element 32 and to a second radiating antenna element 34. In this arrangement, both first and second radiating antenna elements 32, 34 may connect to a radio signal source, as well as to ground. In FIG. 2, first radiating antenna element 32 connects to feeding portion 30 in a proximity of feeding leg 28, while second radiating antenna element 34 connects to feeding portion 30 in a proximity of grounding leg 29. It should be realized that first and second radiating antenna elements 32, 34 may connect to feeding portion 30 in other configurations, for example, in the opposite way to that shown.

Radiating antenna elements 32 and 34 may be dimensioned so as to be resonating at one frequency each. In the present example, assume first radiating antenna element 32 is dimensioned to be radiating at a frequency of about 2.4 GHz, while second radiating antenna element 34 may be dimensioned so as to be resonating at a frequency of about 5.2 GHz. These exemplary frequencies are frequencies that are suitable, for example, for short range wireless communication, for instance, in Bluetooth™ or Wireless LAN 802.11b and 802.11g. Other dimensions/frequencies are possible.

Radiating antenna elements 32, 34 may be provided as strips that have been formed to fit inside the casing of phone 10. From FIG. 2, it can be seen that first radiating antenna element 32 has been angled around circuit board 24 so as to substantially encircle circuit board 24. A process for forming first and second radiating antenna elements 32, 34 will be described in more detail in connection with FIGS. 3*a* and 3*b*.

Figure 3A:
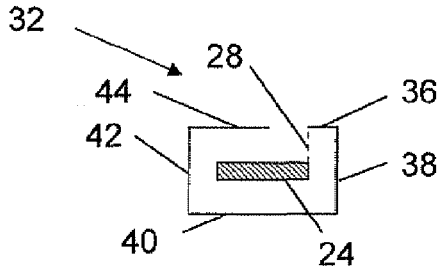
FIG. 3*a* shows a view in a plane going straight through the circuit board of a first radiating antenna element in the antenna arrangement according to the present invention.

FIG. 3*a* shows first radiating antenna element 32 in a view in a plane going straight through circuit board 24, i.e., in a plane that is perpendicular to an upper surface of circuit board 24 and to the feeding plane. First radiating antenna element 32 may include a first leg 36 that connects to feeding leg 28 (shown as a dashed line). First leg 36 may be essentially perpendicular to feeding leg 28 and extend outward in a direction from circuit board 24 in the feeding plane. First leg 36 may be joined at essentially right angles to a second leg 38, which may extend downward from first leg 36 essentially parallel with the feeding leg 28 in a direction toward circuit board 24. In one implementation, second leg 38 may be displaced angularly (e.g., sideways) from circuit board 24 such that first leg 36 does not touch circuit board 24. So arranged, second leg 38 may pass in parallel with a first long side of circuit board 24 and then continue to an endpoint at a distance from a bottom side of circuit board 24. At which point, second leg 38 may join a third leg 40 at essentially right angles. Third leg 40 may in turn extend in parallel with and below the bottom side of circuit board 24 beyond an edge of the bottom side to a second opposing long side of circuit board 24. Third leg 40 may then join with a fourth leg 42 which may extend upward substantially in parallel with the second opposing long side of the circuit board 24. The fourth leg 42 is thus also provided in parallel with the second leg 38. Fourth leg 42 may extend upward to a point at which it reaches the feeding plane, where it may join, at essentially right angles, a fifth leg 44. Fifth leg 44 may extend in a direction toward feeding leg 28 in the feeding plane. Fifth leg 44 may be the ultimate leg of first radiating antenna element 32 and therefore, fifth leg 44 may have an unattached or a free end. In one implementation, a space or gap may be provided between the free end of fifth leg 44 and the point at which first leg 36 joins feeding leg 28. That is, circuit board 24 may not be entirely encircled by first radiating antenna element 32. In other words, first radiating antenna element may partially encircle a portion of circuit board 24.

In this implementation, a ring shaped first radiating antenna element 32 may be provided that encircles most of circuit board 24, exhibiting a structure that is furthermore provided in a space-conserving formation. First radiating antenna element 32 may cover, for example, 270 degrees or more (out of the 360 degrees) of a representative cross-sectional circle around circuit board 24. The gap provided can therefore account for between about 10 to about 90 degrees of a circle around circuit board 24, for example, between about 20 to about 60 degrees and, preferably, about 45 degrees out of a full circle around the board. It should here also be realised that first radiating antenna element 32 need not be provided in sections that are bent this way with angles of ninety degrees. The angles at the junctions of adjacent legs may differ from that described and, in one implementation, may vary from one to another, I.e., be non-uniform. It is also possible to provide first radiating antenna element 32 as, for instance, an integrally-formed single element that includes curved portions that substantially form a circle, an ellipse or any other regular or irregular shape about circuit board 24. It is furthermore possible that the legs of first radiating antenna element 32 may conform around circuit board 24 in a direction other (e.g., opposite to) than the direction shown in FIGS. 2 and 3*a*.

Figure 3B:
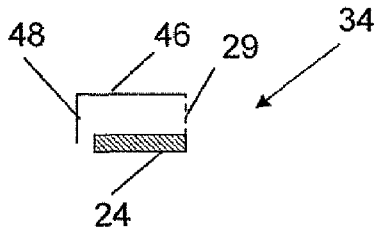
FIG. 3*b* shows a view in a plane going straight through the circuit board of a second radiating antenna element in the antenna arrangement according to the present invention.

FIG. 3*b* shows second radiating antenna element 34 in a view in a plane going straight through circuit board 24, i.e., in a plane that is perpendicular to the upper surface of circuit board 24. Second radiating antenna element 34 may connect in the feeding plane to the feeding portion (not shown) at the grounding leg 29 (shown with a dashed line). From this point, a first leg 46 may extend outward in the feeding plane in a direction toward and past the opposing long side of circuit board 24. First leg 48 may join a second leg 48 essentially at right angles, which in turn may itself extend downward toward the bottom side, in parallel with the second long side of circuit board 24. Second radiating antenna element 34 may encircle about half of the width of circuit board 24. Other amounts of partially encircling are possible.

Second radiating antenna element 34 may provides space conservation and a configuration of combined first and second radiating elements 32, 34 may provide space conservation as an antenna arrangement. It should here also be realized that second radiating antenna element 34 need not be provided in sections that are angled as shown, i.e., an angle of ninety degrees. The bend between the adjoined legs may be at any of a number of various angles. It is also possible to provide second radiating antenna element 34 as an integrally-formed single element that includes a curved length thereof to form half a circle, half an ellipse or any other regular or irregular shape that substantially encircles about half of a cross-sectional representative area of circuit board 24. It is furthermore possible that second radiating antenna element 24 has the opposite orientation of the one shown in FIGS. 2 and 3*b*.

Figure 4:
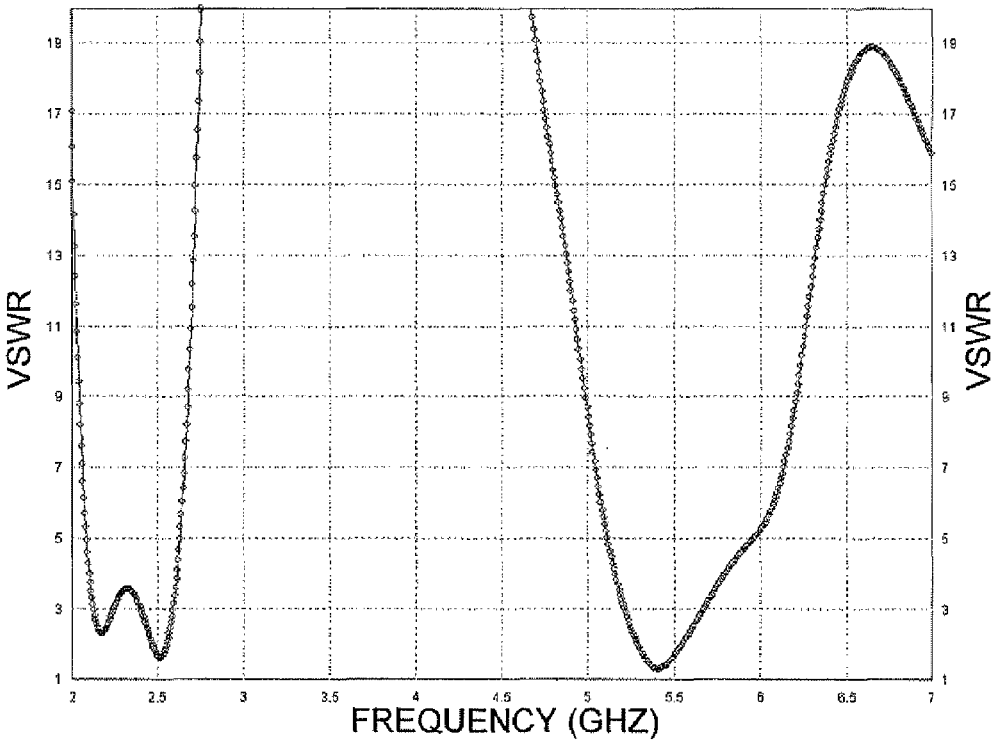
FIG. 4 shows a VSWR chart of the antenna arrangement in FIGS. 2, 3*a* and 3*b*.

FIG. 4 shows a simulated VSWR (voltage standing wave ratio) curve for the exemplary antenna arrangement of FIGS. 2 and 3. As can be seen from the graph, performance is very good for the frequencies relative to the size of the antenna arrangement.

Figure 5:
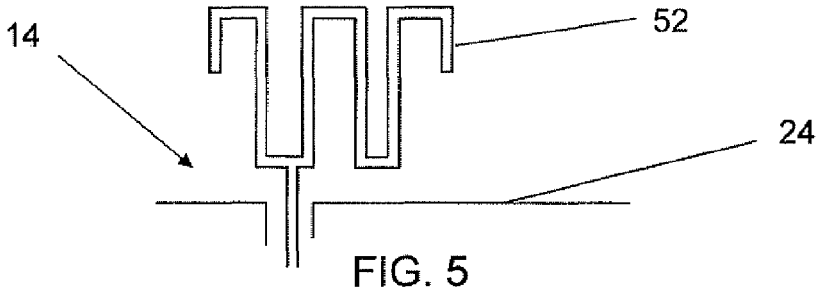
FIG. 5 schematically shows a side view of a further meandering antenna element of the antenna arrangement that can be provided in a lower part of the board.

As mentioned above the pen-shaped device is advantageously implemented in a mobile phone. For this reason, phone 10 may be provided with additional antennas, such as a third antenna element in the form of a phone antenna that is adapted for use in one or more mobile phone frequency bands. One example of this type of antenna is shown in FIG. 5, A third radiating antenna element 52 is connected to a radio circuit (not shown) at the bottom end of circuit board 24. Third radiating antenna element 54 may be provided as a branched monopole strip antenna having a meandering shape. Third radiating antenna element 54 antenna may also be provided on a substrate, which may be a plastic film. The film may then be bent in order to conform third radiating antenna element 52 substantially around circuit board 24.

When phone 10 has third radiating antenna element 54, first and second radiating antenna elements 32, 34 can aid the diversity of third radiating antenna element 54.

The invention has a number of further advantages. It provides a small sized antenna arrangement that can be provided inside a (thin) elongated portable communication device and still have good antenna properties for the frequencies that are of interest. It is further simple and can be produced at a low cost.

It should here be realized that the antenna arrangement can be modified in any number of ways. For example, first radiating antenna element 32 may have any arbitrary cylinder shape, or any other shape. Second radiating antenna element 34 need not be limited to encircling half circuit board 24. Second radiating antenna element 34 may alternatively have any length corresponding to the frequency at which it is to resonate. Second radiating antenna element 34 may nevertheless be bent around circuit board 24. It should also be realized that the antenna arrangement need only include first radiating antenna element 32 and not necessarily second and third radiating antenna elements 34, 54. The antenna arrangement may include first and second radiating antenna elements 32, 34, as is indicated in FIG. 2. It is furthermore possible that the antenna arrangement only includes first and third antenna elements 34, 54, as well as all three together. Any combination of radiating antenna elements is possible.

It should also be realised that if further types of communication are needed, phone 10 may include more antennas for the additional types of communications. The portable communication device is not limited to being a phone or an optical reading device, but may be any type of portable communication device configured to (wirelessly) communicate with other devices.

Therefore the present invention is only to be limited by the following claims.

What is claimed is:

1. A portable communication device comprising:

an elongated circuit board including a ground plane; and an antenna arrangement, provided at a first length-wise end of the elongated circuit board, including:

a first radiating antenna element formed of a strip having dimensions that enable operation at a first frequency, where the first radiating antenna element covers an angle in a range of from about 270 to about 350 degrees of a circular plane around the elongated circuit board, and a second radiating antenna element formed of a strip having dimensions that enable operation at a second frequency, where the first and second frequencies differ.

2. The portable communication device of claim 1, where the first frequency is a short range wireless communication frequency.

3. A portable communication device comprising:

an elongated circuit board including a ground plane; and an antenna arrangement, provided at a first length-wise end of the elongated circuit board, including:

a first radiating antenna element formed of a strip having dimensions that enable operation at a first frequency, and a second radiating antenna element formed of a strip having dimensions that enable operation at a second frequency, where:

the first and second frequencies differ, the first radiating antenna element partially encircles the elongated circuit board by a first amount, the second radiating antenna element partially encircles the elongated circuit board by a second amount, the first amount is greater than the second amount, and together, the first radiating antenna element and the second radiating antenna element entirely encircle a circular plane that cross-sections the first length-wise end of the elongated circuit board.

4. The portable communication device of claim 3, where the second radiating antenna element is connected to the first radiating antenna element.

5. The portable communication device of claim 3, where the second radiating antenna element encircles up to approximately half of the circular plane.

6. The portable communication device of claim 1, where the second frequency is a short range wireless communication frequency.

7. The portable communication device of claim 1, where the antenna arrangement further comprises a third radiating antenna element in a form of a strip provided at a second length-wise end of the elongated circuit board opposite the first length-wise end of the elongated circuit board.

8. The portable communication device of claim 7, where the third radiating antenna element is a monopole antenna.

9. The portable communication device of claim 7, where the third radiating antenna element comprises a meandering strip antenna element.

10. The portable communication device of claim 7, where the third radiating antenna element has dimensions that enable operation at a mobile communication frequency band.

11. The portable communication device of claim 1, where the portable communication device comprises a mobile phone.

12. An antenna arrangement, including an elongated circuit board comprised of a radio circuit and a ground plane, for use in an elongated portable communication device, the antenna arrangement comprising:

a first radiating antenna element, having dimensions for operation at a first frequency, provided as a first strip partially encircling a first length-wise end portion of the elongated circuit board, where the first radiating antenna element connects to the radio circuit via a feeding line;

a second radiating antenna element, having dimensions for operation at a second frequency, provided as a second strip partially encircling the first length-wise end portion of the elongated circuit board, where the second radiating antenna element connects to the ground plane via a grounding line; and a third strip provided between the first radiating antenna element and the second radiating antenna element, where the third strip provides a connection from each of the first and second radiating elements to the ground plane and the radio circuit, via which different radio signals may be respectively fed to the first radiating antenna element and the second radiating antenna element.

13. The antenna arrangement of claim 12, where the first radiating antenna element comprises an angle in a range of from about 270 to about 350 degrees of a circle around the elongated circuit board.

14. The antenna arrangement of claim 12, where the first frequency is a short range wireless communication frequency.

15. The antenna arrangement of claim 12, where a radius of the second radiating antenna element is smaller than a radius of the first radiating antenna element.

16. The antenna arrangement of claim 12, where, together, the second radiating antenna element and the first radiating antenna element entirely encircle a circular plane that cross-sections the first length-wise end portion of the elongated circuit board.

17. The antenna arrangement of claim 13, where the second strip encircles up to approximately half of a portion of the elongated circuit board.

18. The antenna arrangement of claim 12, where the second frequency is a short range wireless communication frequency.

19. The antenna arrangement of claim 12, further comprising:

a third radiating antenna element provided as a third strip at a second length-wise end of the elongated circuit board opposite the first length-wise end of the elongated circuit board.

20. The antenna arrangement of claim 19, where the third radiating antenna element is a monopole antenna.

21. The antenna arrangement of claim 19, where the third radiating antenna element comprises a meandering strip antenna element.

22. The antenna arrangement of claim 19, where the third radiating antenna element has dimensions that enable operation at a mobile communication frequency band.

* * * * *